United States Patent [19]

Zink et al.

[11] Patent Number: 5,024,988

[45] Date of Patent: Jun. 18, 1991

[54] PRESSURE-OR HEAT-SENSITIVE RECORDING MATERIAL

[75] Inventors: Rudolf Zink, Alemannenstrasse; Rox Phaff, Gstaadmattstrasse, both of Switzerland

[73] Assignee: Ciba-Geigy Corporation, Ardsley, N.Y.

[21] Appl. No.: 442,087

[22] Filed: Nov. 28, 1989

[30] Foreign Application Priority Data

Dec. 2, 1988 [CH] Switzerland ..... 4484/88
Jul. 6, 1989 [CH] Switzerland ..... 2510/89

[51] Int. Cl.[5] ..... B41M 5/16; B41M 5/18; B41M 5/22

[52] U.S. Cl. ..... 503/212; 427/151; 503/217; 503/218; 503/220; 503/223

[58] Field of Search ..... 427/150–152; 503/217, 218, 220, 223, 212, 226

[56] References Cited

U.S. PATENT DOCUMENTS 4,688,059 8/1987 Schmidt et al. ..... 503/220

*Primary Examiner*—Bruce H. Hess
*Attorney, Agent, or Firm*—George R. Dohmann; Edward McC. Roberts

[57] ABSTRACT

A pressure-sensitive or heat-sensitive recording material in which the color reactant system contains, as main components (A) a polycyclic compound of the formula

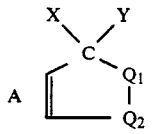

(1)

in which

X is a monocyclic or polycyclic aromatic or heteroaromatic radical,

Y is a substituent detachable as an anion, $Q_1$ is —O—, —S—, >N—R or >N—NH—R, $Q_2$ is —$CH_2$—, —CO—, —CS— or —$SO_2$— and R is hydrogen, $C_1$–$C_{12}$alkyl, $C_5$–$C_{10}$cycloalkyl, aryl such as phenyl or aralkyl such as benzyl, and ring A is an aromatic or heterocyclic radical having 6 ring atoms, which can have an aromatic fused ring, it being possible for both ring A and the fused ring to be substituted, (B) an organic condensation component capable of forming a chromogenic compound with component (A) and (C) an electron-withdrawing and a color-developing component.

32 Claims, No Drawings

PRESSURE-OR HEAT-SENSITIVE RECORDING MATERIAL

Heat-sensitive recording materials are in general prepared by applying to the surface of a substrate such as paper a coating composition obtained by finely milling and dispersing a colourless chromogenic substance (colour former) and a colour developer as electron acceptor, mixing the resulting dispersions with one another and adding a binder, filler and other auxiliaries, for example lubricants and/or sensitizers. Upon exposure to heat, a chemical reaction of the chromogenic compound with the colour developer takes place in the coating with colour formation. In pressure-sensitive recording materials, the colour images are usually formed by applying pressure to the microcapsules which have been attached to the paper and enclose the chromogenic substance, the colour reaction between the chromogen and the acceptor taking place in the presence of solvents.

It has now been found that a pressure-sensitive or heat-sensitive recording material is obtained by using, instead of the leuko dye, the starting components which are suitable for forming the desired dye, colour formation then being obtained by the application of pressure or exposure to heat.

The present invention therefore relates to a pressure-sensitive or heat-sensitive recording material which contains (A) a polycyclic compound of the formula

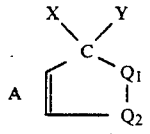

(1)

in which

X is a monocyclic or polycyclic aromatic or heteroaromatic radical,

Y is a substituent detachable as an anion, $Q_1$ is —O—, —S—, >N—R or >N—NH—R, $Q_2$ is —$CH_2$—, —CO—, —CS— or —$SO_2$— and R is hydrogen, $C_1$–$C_{12}$alkyl, $C_5$–$C_{10}$cycloalkyl, aryl such as phenyl, or aralkyl such as benzyl, and ring A is an aromatic or heterocyclic radical having 6 ring atoms, which can have an aromatic fused ring in which not only ring A but also the fused ring can be substituted, (B) is an organic condensation component and (C) is an electron-withdrawing and colour-developing component.

Depending of the recording material, components (A), (B) and (C) make contact by means of pressure or heat and leave behind recorded images on the substrate. The colour produced is determined by the type of components (A) and (B), which represent the electron donor and the chromogen part. The colour formation is effected by component (C). Thus, it is possible to produce the desired colours, for example yellow, orange, red, violet, blue, green, grey, black or mixed colours by a suitable combination of the individual components. A further suitable combination consists in using components (A) and (B) together with one or more conventional colour formers, for example 3,3-bis(aminophenyl)phthalides such as CVL, 3-indolyl-3-aminophenylaza- or -diazaphthalides, 3,3-bis(indolyl)phthalides, 3-aminofluorans, 6-dialkylamino-2-dibenzylaminofluorans, 6-dialkylamino-3-methyl-2-arylaminofluorans, 3,6-bisalkoxyfluorans, 3,6-bis(-diarylamino)fluorans, leukoauramines, spiropyrans, spirodipyrans, benzoxazines, chromenopyrazoles, chromenoindoles, phenoxazines, phenothiazines, quinazolines, rhodamine lactams, carbazolylmethanes or further triarylmethane leuko dyes.

The compounds of the formula (1) (component (A)) contain, as part of their structure, the basic structure, for example, of a lactone, lactam, sultone, sultam or phthalan, and these basic structures are subject—before, during or after the reaction of component (A) with the condensation component (B)—to ring opening or bond cleavage upon contact with the colour developer (component (C)), which presumably also occur in the previously customary recording materials.

In formula (1), the heteroaromatic radical X is advantageously bound to the central (meso) carbon atom of the polycyclic compound via a carbon atom of the hetero ring.

Examples of heteroaromatic radicals X are thienyl, acridinyl, benzofuranyl, benzothienyl, napthothienyl or phenothiazinyl radicals, but advantageously pyrrolyl, indolyl, carbazolyl, julolidinyl, kairolinyl, indolinyl, dihydroquinolinyl or tetrahydroquinolyl radicals.

The mono- or polynuclear heteroaromatic radical can be mono- or poly-substituted on the ring. Examples of suitable C substituents are halogen, hydroxyl, cyano, nitro, lower alkyl, lower alkoxy, lower alkylthio, lower alkoxycarbonyl, acyl having 1 to 8 carbon atoms, preferably lower alkylcarbonyl, amino, lower alkylamino, lower alkylcarbonylamino or lower dialkylamino, $C_5$–$C_6$cycloalkyl, benzyl or phenyl, while examples of N substituents comprise $C_1$–$C_{12}$alkyl, $C_2$–$C_{12}$alkenyl, $C_5$–$C_{10}$cycloalkyl, $C_1$–$C_8$acyl, phenyl, benzyl, phenethyl or phenisopropyl, each of which can be substituted, for example, by cyano, halogen, nitro, hydroxyl, lower alkyl, lower alkoxy, lower alkylamino or lower alkoxycarbonyl.

The alkyl and alkenyl radicals can be straight-chain or branched. Examples of these are methyl, ethyl, n-propyl, isopropyl, n-butyl, 1-methylbutyl, t-butyl, sec-butyl, amyl, isopentyl, n-hexyl, 2-ethylhexyl, isooctyl, n-octyl, 1,1,3,3-tetramethylbutyl, nonyl, isononyl, 3-ethylheptyl, decyl or n-dodecyl and vinyl, allyl, 2-methylallyl, 2-ethylallyl, 2-butenyl or octenyl.

Acyl is in particular formyl, lower alkylcarbonyl, for example acetyl or propionyl, or benzoyl. Further acyl radicals can be lower alkylsulfonyl, for example methylsulfonyl or ethylsulfonyl and phenylsulfonyl. Benzoyl and phenylsulfonyl can be substituted by halogen, methyl, methoxy or ethoxy.

Lower alkyl, lower alkoxy and lower alkylthio are those groups or group components which have 1 to 6, in particular 1 to 3, carbon atoms. Examples of this type of groups are methyl, ethyl, n-propyl, isopropyl, n-butyl, sec-butyl, amyl, isoamyl or hexyl and methoxy, ethoxy, isopropoxy, isobutoxy, tert-butoxy or amyloxy or methylthio, ethylthio, propylthio or butylthio.

Halogen is, for example, fluorine, bromine or preferably chlorine.

Preferred heteroaromatic radicals are substituted 2- or 3-pyrrolyl or in particular 3-indolyl radicals, for example N-$C_1$–$C_8$alkylpyrrol-2-yl, N-phenylpyrrol-3-yl, N-$C_1$–$C_8$alkyl-2-methylindol-3-yl, N-$C_2$–$C_4$alkanoyl-2-methylindol-3-yl, 2-phenylindol-3-yl or N-$C_1$-$C_8$alkyl-2-phenylindol-3-yl radicals.

An aromatic radical X can be a phenyl or naphthyl radical which is unsubstituted or substituted by halogen, cyano, lower alkyl, $C_5$-$C_6$cycloalkyl, $C_1$-$C_8$acyl, —$NR_1R_2$, —$OR_3$ or —$SR_3$.

An aromatic radical X is preferably a substituted phenyl radical of the formula

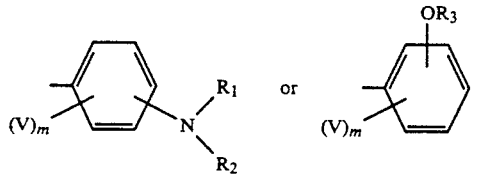

(1a) (1b)

In these formulae, $R_1$, $R_2$ and $R_3$, independently of one another, are each hydrogen, unsubstituted or halogen-, hydroxyl-, cyano- or lower alkoxy-substituted alkyl having a maximum number of 12 carbon atoms, acyl having 1 to 8 carbon atoms, cycloalkyl having 5 to 10 carbon atoms or phenalkyl or phenyl which is unsubstituted or ring-substituted by halogen, trifluoromethyl, cyano, lower alkyl, lower alkoxy, lower alkoxycarbonyl, —NX'X" or 4-NX'X"-phenylamino, in which X' and X", independently of one another, are hydrogen, lower alkyl, cyclohexyl, benzyl or phenyl, or $R_1$ and $R_2$ together with the nitrogen atom linking them form a five- or six-membered, preferably saturated, heterocyclic radical. V is hydrogen, halogen, lower alkyl, $C_1$-$C_{12}$alkoxy, $C_1$-$C_{12}$acyloxy, benzyl, phenyl, benzyloxy, phenyloxy, halogen-, cyano-, lower alkyl-or lower alkoxy-substituted benzyl or benzyloxy, or is the group —$NT_1T_2$. $T_1$ and $T_2$, independently of one another, are each hydrogen, lower alkyl, $C_5$-$C_{10}$cycloalkyl, unsubstituted or halogen-, cyano-, lower alkyl- or lower alkoxy-substituted benzyl, or acyl having 1 to 8 carbon atoms and $T_1$ is also unsubstituted or halogen-, cyano-, lower alkyl- or lower alkoxy-substituted phenyl. m is 1 or 2.—$NR_1R_2$ and —$OR_3$ are preferably in the para-position relative to the linkage point. One V is preferably in the ortho-position relative to the linking point.

R, $R_1$, $R_2$ and $R_3$ as alkyl are, for example, the substituents listed above for alkyl radicals.

Substituted alkyl radicals in $R_1$, $R_2$ and $R_3$, are in particular cyanoalkyl, halogenoalkyl, hydroxyalkyl, alkoxyalkyl each preferably having a total of 2 to 8 carbon atoms, for example 2-cyanoethyl, 2-chloroethyl, 2-hydroxyethyl, 2-methoxyethyl, 2-ethoxyethyl, 2,3-dihydroxypropyl, 2-hydroxy-3-chloropropyl, 3-methoxypropyl, 4-methoxybutyl or 4-propoxybutyl.

Examples of R, $R_1$, $R_2$, $R_3$, $T_1$ and $T_2$ as cycloalkyl are cyclopentyl, cycloheptyl or preferably cyclohexyl. The cycloalkyl radicals can contain one or several $C_1$-$C_4$alkyl radicals, preferably methyl groups, and have a total of 5 to 10 carbon atoms.

R, $R_1$, $R_2$ and $R_3$ as aralkyl or phenalkyl can be phenethyl, phenylisopropyl or in particular benzyl.

Preferred substituents in the phenalkyl and phenyl group of the R radicals are, for example, halogen, cyano, methyl, trifluoromethyl, methoxy or carbomethoxy. Examples of these araliphatic and aromatic radicals are methylbenzyl, 2,4- or 2,5-dimethylbenzyl, chlorobenzyl, dichlorobenzyl, cyanobenzyl, tolyl, xylyl, chlorophenyl, methoxyphenyl, 2,6-dimethylphenyl, trifluoromethylphenyl or carbomethoxyphenyl.

The acyloxy radical in V is, for example, formyloxy, lower alkylcarbonyloxy, for example acetoxy or propionyloxy, or benzoyloxy. V as a $C_1$-$C_{12}$alkoxy radical can be a straight-chain or branched group, for example methoxy, ethoxy, isopropoxy, n-butoxy, tert-butoxy, amyloxy, 1,1,3,3-tetramethylbutoxy, n-hexyloxy, n-octyloxy or dodecyloxy.

A heterocyclic radical formed by the substituent pair ($R_1$ and $R_2$) together with the common nitrogen atom is, for example, pyrrolidino, piperidino, pipecolino, morpholino, thiomorpholino, piperazino, N-alkylpiperazino, for example N-methylpiperazino, N-phenylpiperazino or N-alkylimidazolino. Preferred saturated heterocyclic radicals for —$NR_1R_2$ are pyrrolidino, piperidino or morpholino.

The substituents $R_1$ and $R_2$ are preferably cyclohexyl, benzyl, phenethyl, cyano(lower alkyl), for example β-cyanoethyl or primarily lower alkyl, for example methyl, ethyl or n-butyl.—$NR_1R_2$ is preferably also pyrrolidinyl. $R_3$ is preferably lower alkyl or benzyl.

V can be advantageously hydrogen, halogen, lower alkyl, for example methyl, benzyloxy, $C_1$-$C_8$alkoxy, primarily lower alkoxy, for example methoxy, ethoxy, isopropoxy or tert-butoxy, or the group —$NT_1T_2$, one of the radicals $T_1$ and $T_2$ being preferably $C_1$-$C_8$acyl or lower alkyl and the other hydrogen or lower alkyl. The acyl radical is in this case in particular lower alkylcarbonyl, for example acetyl or propionyl. Preferably, V is acetylamino, dimethylamino, diethylamino, benzyloxy or in particular lower alkoxy and especially ethoxy or hydrogen.

Y substituents on the central (meso) carbon atom are easily detachable substituents which are thereby converted into an anion. These substituents can be halogen atoms, aliphatic, cycloaliphatic, araliphatic, aromatic or heterocyclic ether groups, for example alkoxy, heteroaryloxy, aryloxy, cycloalkoxy and aralkoxy, or in particular acyloxy groups, which correspond, for example, to the formula $$R'—(NH—)_{n-1}—Q'—O— \quad (1c)$$

in which R' is an organic radical, preferably unsubstituted or substituted $C_1$-$C_{22}$alkyl, aryl, cycloalkyl, aralkyl or heteroaryl, Q' is —CO— or —$SO_2$— and n is 1 or 2, preferably 1. Examples of suitable acyloxy groups are acetoxy, propionyloxy, chloroacetoxy, benzoyloxy, methylsulfonyloxy, ethylsulfonyloxy, chloroethylsulfonyloxy, trifluoromethylsulfonyloxy, 2-chloroethylsulfonylacetoxy, phenylsulfonyloxy, tolylsulfonyloxy, ethylaminocarbonyloxy or phenylaminocarbonyloxy.

Preferably, Y is an acyloxy group of the formula R"—CO—O— in which R" is lower alkyl or phenyl.

$Q_1$ is preferably an oxygen atom, while $Q_2$ is preferably —$SO_2$— or in particular —CO—. In >N—R or >N—NH—R as $Q_1$, R is preferably hydrogen, methyl or phenyl.

A six-membered aromatic ring A is preferably a benzene ring which is unsubstituted or substituted by halogen, cyano, nitro, lower alkyl, lower alkoxy, lower alkylthio, lower alkylcarbonyl, lower alkoxycarbonyl, amino, lower alkylamino, lower dialkylamino or lower alkylcarbonylamino. A 6-membered heterocyclic ring A is in particular a nitrogen-containing heterocycle of aromatic character, for example a pyridine or pyrazine ring. Ring A can also contain a fused aromatic ring, preferably a benzene ring and is thus, for example, a naphthalene, quinoline or quinoxaline ring.

Preferred 6-membered aromatic or heterocyclic radicals A comprise the 2,3-pyridino, 3,4-pyridino, 2,3-pyrazino, 2,3-quinoxalino, 1,2-naphthalino, 2,3-naphthalino or 1,2-benzo radical, which is unsubstituted or substituted by halogen, such as chlorine or bromine, nitro, lower alkyl, lower alkoxy, lower alkylthio or an amino group which is unsubstituted or substituted as defined above, the unsubstituted or halogeno-substituted, especially chlorine-tetrasubstituted 1,2-benzo radical being particularly preferred.

Particular important components (A) for the colour reactant system have the formula

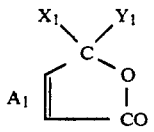
(2)

in which $A_1$ is a benzene or pyridine ring which is unsubstituted or substituted by halogen, cyano, lower alkyl, lower alkoxy or lower dialkylamino, $Y_1$ is halogen, acyloxy and in particular lower alkylcarbonyloxy or benzoyloxy and $X_1$ is a 3-indolyl radical of the formula

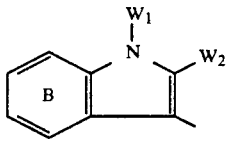
(2a)

or a substituted phenyl radical of the formula

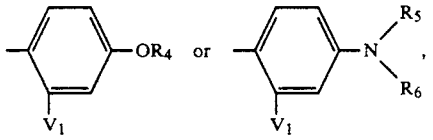
(2b) (2c)

in which $W_1$ is hydrogen, unsubstituted or cyano- or lower alkoxy-substituted $C_1$–$C_8$alkyl, acetyl, propionyl or benzyl, $W_2$ is hydrogen, lower alkyl, in particular methyl, or phenyl, $R_4$, $R_5$ and $R_6$, independently of one other, are each unsubstituted or hydroxy-, cyano- or lower alkoxy-substituted alkyl having a maximum number of 12 carbon atoms, $C_5$–$C_6$cycloalkyl, benzyl, phenethyl or phenyl, or ($R_5$ and $R_6$) together with the nitrogen atom linking them are pyrrolidino, piperidino or morpholino, $V_1$ is hydrogen, halogen, lower alkyl, $C_1$–$C_8$alkoxy, benzyloxy or the group —$NT_3T_4$, $T_3$ and $T_4$, independently of one another, are each hydrogen, lower alkyl, lower alkylcarbonyl or unsubstituted or halogen-, methyl- or methoxy-substituted benzoyl, and ring B is unsubstituted or substituted by halogen, lower alkyl, such as methyl or isopropyl or by lower dialkylamino such as dimethylamino.

Of the compounds of the formula (2), the lactone compounds in which $X_1$ is a 3-indolyl radical of the formula (2a) in which $W_1$ is $C_1$–$C_8$alkyl, $W_2$ is methyl or phenyl, and $Y_1$ is lower alkylcarbonyloxy, in particular acetoxy, are preferred.

Of particular interest are lactone compounds of the formula

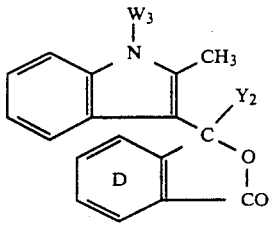
(3)

in which ring D is unsubstituted or chlorine-tetrasubstituted, $Y_2$ is acetoxy or benzoyloxy and $W_3$ is $C_1$–$C_8$-alkyl such as ethyl, n-butyl or n-octyl.

Particular preference is also given to lactone compounds of the formula

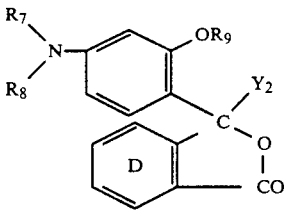
(4)

in which D and $Y_2$ are as defined in formula (3) and $R_7$, $R_8$ and $R_9$ are each lower alkyl.

Compounds of the formula (1) in which the detachable substituent Y is an acyloxy group can be prepared by reacting a keto acid or carbinol compound (lactol) of the formula

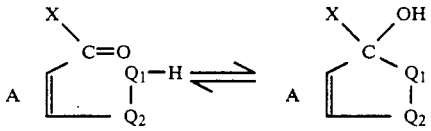
(i)

in which A, $Q_1$, $Q_2$ and X are as defined above with an acylating agent.

Suitable acylating agents are reactive functional derivatives of aliphatic, cycloaliphatic or aromatic carboxylic acids or sulfonic acids, in particular carboxylic acid halides or anhydrides, for example acetyl bromide, acetyl chloride, benzoyl chloride and especially acetic anhydride. Mixed anhydrides, that is, anhydrides of two different acids, can also be used.

Compounds of the formula (1) in which the detachable substituent Y is halogen are prepared by replacing the hydroxyl group of the carbinol compound of the formula (i) by a halogen atom by means of a halogenating agent, for example by means of thionyl chloride, phosgene, phosphorus oxychloride, phosphorus trichloride or phosphorus pentachloride in dimethylformamide, dichlorobenzene, benzene, toluene or ethylene dichloride. The halogenating agent can also be used in excess in the absence of a solvent.

By reacting compounds of the formula (1) in which Y is halogen or acyloxy with aliphatic, cycloaliphatic, araliphatic, aromatic or heterocyclic hydroxyl compounds, it is possible to introduce ether groups as further detachable substituents Y.

Compounds of the formula (1) in which the detachable substituent Y is an ether group can also be obtained by etherification of the compounds of the formula (i) with an alkylating agent or aralkylating agent.

Suitable alkylating agents are alkyl halides, for example methyl or ethyl iodide, ethyl chloride or dialkyl sulfate, such as dimethyl sulfate or diethyl sulfate. Suitable aralkylating agents are in particular benzyl chloride or the corresponding substitution products, for example 4-chlorobenzyl chloride, which are preferably used in a nonpolar organic solvent, for example benzene, toluene or xylene.

Specific examples for the compounds of the formulae (1) to (4), such as are mentioned, inter alia, in J. Am. Chem. Soc. 38 2101–2119 and Helvetica Chimica Acta 42 (1959) 1085–1100, include 3-(4'-diethylamino-2'-ethoxyphenyl)-3-acetoxyphthalide,
3-(4'-diethylaminophenyl)-3-acetoxyphthalide,
3-(1'-ethyl-2'-methylindol-3'-yl)-3-acetoxyphthalide,
3-(4'-dimethylaminophenyl)-3-acetoxy-6-dimethylaminophthalide,
3-(1'-n-octyl-2'-methylindol-3'-yl)-3-acetoxyphthalide,
3-(1'-ethyl-2'-methylindol-3'-yl)-3-acetoxy-4,5,6,7-tetrachlorophthalide,
3-(1'-ethyl-2'-methylindol-3'-yl)-3-acetoxy-5,6-dichlorophthalide,
3-(1'-n-octyl-2'-methylindol-3'-yl)-3-acetoxy-4,5,6,7-tetrachlorophthalide,
3-(1'-n-octyl-2'-methylindol-3'-yl)-3-acetoxy-5,6-dichlorophthalide,
3-(1'-n-octyl-2'-methylindol-3'-yl)-3-acetoxy-5-methylphthalide,
3-(1'-ethyl-2'-methylindol-3'-yl)-3-acetoxy-4-azaphthalide,
3-(1'-n-octyl-2'-methylindol-3'-yl)-3-acetoxy-4-azaphthalide,
3-(1'-ethyl-2'-methylindol-3'-yl)-3-propionyloxy-4,5,6,7-tetrachlorophthalide,
3-(1'-ethyl-2'-methylindol-3'-yl)-3-benzoyloxy-4,5,6,7-tetrachlorophthalide,
3-(1'-methyl-2'-phenylindol-3'-yl)-3-acetoxy-4,5,6,7-tetrachlorophthalide,
3-(1'-n-octyl-2'-methylindol-3'-yl)-3-acetoxy-7-azaphthalide,
3-(4'-diethylamino-2'-acetoxyphenyl)-3-acetoxy-4,5,6,7-tetrachlorophthalide,
3-(4'-N-cyclohexyl-N-methylamino-2'-ethoxyphenyl)-3-acetoxyphthalide,
3-(4'-N-cyclohexyl-N-methylamino-2'-methoxyphenyl)-3-acetoxy-4-azaphthalide,
3-(4'-N-ethyl-N-p-toluidino-2'-methoxyphenyl)-3-acetoxyphthalide,
3-(4'-N-ethyl-N-isoamylamino-2'-methoxyphenyl)-3-acetoxyphthalide,
3-(4'-pyrrolidino-2'-methoxyphenyl)-3-acetoxyphthalide,
3-(4'-diethylamino-2'-ethoxyphenyl)-3-acetoxy-4-azaphthalide,
3-(4'-dimethylamino-5'-methylphenyl)-3-acetoxyphthalide,
3-(4'-diethylamino-5'-methylphenyl)-3-acetoxyphthalide,
3-(2'-acetoxy-4'-dimethylamino-5'-methylphenyl)-3-acetoxyphthalide,
3-(4'-di-n-butylamino-2'-n-butoxyphenyl)-3-acetoxyphthalide,
3-(4'-di-n-butylamino-2'-ethoxyphenyl)-3-acetoxyphthalide,
3-(4'-diethylamino-2'-n-propoxyphenyl)-3-acetoxyphthalide,
3-(3'-methoxyphenyl)-3-acetoxy-6-dimethylaminophthalide,
3-(4'-diethylamino-2'-ethoxyphenyl)-3-acetoxy-4,5,6,7-tetrachlorophthalide,
3-(4'-di-n-butylamino-2'-ethoxyphenyl)-3-acetoxy-4,5,6,7-tetrachlorophthalide,
3-(4'-diethylamino-2'-acetoxyphenyl)-3-acetoxyphthalide,
3-(4'-diethylamino-5'-methyl-2'-acetoxyphenyl)-3-acetoxy-4,5,6,7-tetrachlorophthalide,
3-(4'-di-n-butylaminophenyl)-3-acetoxyphthalide,
3-(4'-dimethylaminophenyl)-3-acetoxy-6-chlorophthalide,
3-(4'-di-2''-cyclohexylethylaminophenyl)-3-acetoxyphthalide,
3-(julolidin-6'-yl)-3-acetoxyphthalide,3-kairolinyl-3-acetoxyphthalide,
3-(2',4'-bis-dimethylaminophenyl)-3-acetoxyphthalide,
3-(2'-acetylamino-4'-dimethylaminophenyl)-3-acetoxyphthalide,
3-(N-ethyl-carbazol-(3')-yl)-3-acetoxyphthalide,
3-(1'-ethyl-2'-methylindol-(3')-yl)-3-chlorophthalide,
3-(1'-ethyl-2'-methylindol-(3')-yl)-3-chlorobenzoxathiol-1,1-dioxide,
3-(4'-diethylamino-2'-ethoxyphenyl)-3-chlorophthalide,
3-(4'-dimethylaminophenyl)-3-methoxy-6-dimethylaminophthalide,
3-(1'-ethyl-2'-methylindol-(3')-yl)-3-methoxy-4,5,6,7-tetrachlorophthalide,
3-(1'-ethyl-2'-methylindol-3'-yl)-3-benzyloxy-4,5,6,7-tetrachlorophthalide,
3-(2'-methylindol-3'-yl)-3-methoxyphthalide,
3-(1'-n-butyl-2'-methyl-indol-3'-yl)-3-methoxyphthalide,
3-(2'-acetoxy-5'-bromophenyl)-3-acetoxyphthalide,
3-(3'-diacetylamino-4'-methylphenyl)-3-acetoxyphthalide,
3-(4'-chlorophenyl)-3-chlorophthalide.

Suitable condensation components (component B) are all coupling components customary in azo chemistry and known from the technical literature, for example H. R. Schweizer, Künstliche Org. Farbstoffe und ihre Zwischenprodukte (Synethic Organic Dyes and their Intermediates), Springer Verlag 1964, p. 420 ff.

Of the large number of possibilities, the following are suitable: condensation components from the benzene series, the naphthalene series, the open-chain active methylene compounds and the heterocyclic series.

Examples of condensation components are N-substituted aminophenylethylene compounds, N-substituted aminophenylstyrene compounds, acylacetarylamides, monohydric or polyhydric phenols, phenol ethers, (phenetols), 3-aminophenol ethers, anilines, naphthylamines, thionaphthenes, diarylamines, naphthols, naphtholcarboxanilides, morpholines, pyrrolidines, piperidines, piperazines, aminopyrazols, pyrazolones, thiophenes, acridines, aminothiazoles, phenothiazines, pyridones, indoles, indolizines, quinolones, pyrimidones, barbituric acids, carbazoles, benzomorpholines, 2-methylenebenzopyrans, dihydroquinolines, tetrahydroquinolines, indolines, kairolines or julolidines.

Particularly preferred condensation components are anilines, such as cresidines, phenetidines or N,N-(lower)dialkylanilines, 2-(lower)alkylindoles, 3-(lower-)alkylindoles or 2-phenylindoles, each of which can be N-substituted by $C_1$–$C_8$alkyl, and 5-pyrazolone. Further preferred coupling components are 3-(lower)alkyl-6-(lower)alkoxy- or -6-(lower)dialkylaminoindoles, each of which can also be N-substituted by $C_1$–$C_8$alkyl.

Specific examples of condensation components are 2-amino-4-methoxytoluene, 3-amino-4-methoxytoluene, N,N-dimethylaniline, N,N-diethylaniline, N,N-dibenzylaniline, 3-n-butoxy-N,N-di-n-butylaniline, 2-methyl-5-acetoxy-N,N-diethylaniline, 4-ethoxydiphenylamine, 3-ethoxy-N,N-dimethylaniline, N,N'-diphenyl-p-phenylenediamine, m-phenetidine, 3-ethoxy-N,N-diethylaniline, 1,3-bis-dimethylaminobenzene, 3-hydroxy-N,N-(di-2'-cyclohexylethyl)aminobenzene, 1,1-(4'-diethylaminophenyl)ethylene, 1-phenyl-3-methyl-5-pyrazolone, 1-phenyl-5-methyl-3-pyrazolone, 1-(2'-chlorophenyl)-5-methyl-3-pyrazolone, N-ethylcarbazole, N-methylpyrrole, 2-methylindole, 2-phenylindole, 1,2-dimethylindole, 1-ethyl-2-methylindole, 1-n-octyl-2-methylindole, 1-methyl-2-phenylindole, 1-ethyl-2-phenylindole, 2-(4'-methoxyphenyl)-5-methoxyindole, 3-methyl-6-methoxyindole, 3-methyl-6-dimethylaminoindole, 1-ethyl-3-methyl-6-methoxyindole, 1-ethyl-3-methyl-6-dimethylaminoindole, 2-(4'-methoxyphenyl)-5-methoxyindole, α-naphthol, β-naphthol, naphthylamine, 1-amino-7-naphthol, 3-cyanoacetylaminophenol, thionaphthene, phenothiazine, 3-methyl-5-aminopyrazole, ethyl pyrimidine-2-acetate, iminodibenzyl, 1-benzyl-2-methylindoline, 2,3,3-trimethylindolenine, benzothiazol-2-yl-acetonitrile, 1,3,3-trimethyl-2-methyleneindoline, 1-ethyl-3-cyano-4-methyl-6-hydroxy-2-pyridone, 3-phenyl-4-methylindolizine, 2,3-diphenylindolizine, 1,1-bis-(1'-ethyl-2'-methylindol-3'-yl)ethylene, 2-dimethylamino-4-methylthiazol, 2-dimethylamino-4-phenylthiazol and 2-methylene-3-methylbenzopyran.

Preferred components (B) also include phthalide and especially fluoran compounds which contain at least one primary amino group or an amino group which is monosubstituted by lower alkyl, cyclohexyl or benzyl. These phthalide and fluoran compounds are described, for example, in FR-A No. 1,553,291, GB-A No. 1,211,393, DE-A No. 2,138,179, DE-A No. 2,422,899 and EP-A No. 138,177.

Specific examples of this type of component (B) are:

2-amino-6-diethylaminofluoran,
2-amino-6-dibutylaminofluoran,
2-amino-3-chloro-6-diethylaminofluoran,
2-methylamino-6-dimethylaminofluoran,
2-ethylamino-6-diethylaminofluoran,
2-methylamino-6-diethylaminofluoran,
2-n-butylamino-6-diethylaminofluoran,
2-n-octylamino-6-diethylaminofluoran,
2-sec-butylamino-6-diethylaminofluoran,
2-benzylamino-6-diethylaminofluoran,
2,3-dimethyl-6-ethylaminofluoran,
2,3,7-trimethyl-6-ethylaminofluoran,
2,3,7-trimethyl-6-ethylamino-5' or 6'-tert-butylfluoran,
2-chloro-3,7-dimethyl-6-ethylamino-5' or 6'-tert-butylfluoran,
2-tert-butyl-6-ethylamino-7-methyl-5' or 6'-tert-butylfluoran,
3-chloro-6-aminofluoran,
3-chloro-6-cyclohexylaminofluoran,
2,7-dimethyl-3,6-bis-ethylaminofluoran,
2-(2'-chloroanilino)-6-ethylamino-7-methylfluoran,
3,3-bis-(4'-dimethylaminophenyl)-6-aminophthalide,
3,3-bis-(4'-ethylaminophenyl)-6-dimethylaminophthalide.

The relative amounts in which components (A) and (B) are used are not critical, but they are preferably used in equimolar amounts.

Not only the polycyclic components (A) but also the condensation components (B) can be used in the recording material by themselves or as mixtures in the form of a combination of two or more thereof.

Inorganic or organic colour developers which are known for recording materials and are capable of withdrawing electrons (electron acceptors) can be used as component (C).

Typical examples of inorganic developers are active clay substances, such as attapulgite clay, acid clay, bentonite, montmorillonite; activated clay, for example acid-activated bentonite or montmorillonite and halloysite, kaolin, zeolite, silica dioxide, zirconium dioxide, alumina, aluminium sulfate, aluminium phosphate or zinc nitrate.

Preferred inorganic colour developers are Lewis acids, for example aluminium chloride, aluminium bromide, zinc chloride, iron(III) chloride, tin tetrachloride, tin dichloride, tin tetrabromide, titanium tetrachloride, bismuth trichloride, tellurium dichloride or antimony pentachloride.

The organic colour developers which can be used are solid carboxylic acids, advantageously aliphatic dicarboxylic acids, for example tartaric acid, oxalic acid, maleic acid, citric acid, citraconic acid or succinic acid, and alkylphenol/acetylene resin, maleic acid/rosin resin, carboxypolymethylene or a partially or completely hydrolysed polymer of maleic anhydride with styrene, ethylene or vinyl methyl ether.

Suitable organic colour developers are in particular compounds having a phenolic hydroxyl group. These can be not only monohydric but also polyhydric phenols. These phenols can be substituted by halogen atoms, carboxyl groups, alkyl radical, aralkyl radicals, such as α-methylbenzyl, α,α-dimethylbenzyl, aryl radicals, acyl radicals, such as arylsulfonyl, or alkoxycarbonyl radicals or aralkoxycarbonyl radicals, such as benzyloxycarbonyl.

Specific examples of phenols which are suitable as component (C) are 4-tert-butylphenol, 4-phenylphenol, methylene-bis-(p-phenylphenol), 4-hydroxydiphenyl ether, α-naphthol, β-naphthol, methyl or benzyl 4-hydroxybenzoate, methyl 2,4-dihydroxybenzoate, 4-hydroxydiphenyl sulfone, 4'-hydroxy-4-methyldiphenyl sulfone, 4'-hydroxy-4-isopropoxydiphenyl sulfone, 4-hydroxy-acetophenone, 2,4-dihydroxybenzophenone, 2,2'-dihydroxydiphenyl, 2,4-dihydroxydiphenyl sulfone, 4,4'-cyclohexylidenediphenol, 4,4'-isopropylidenediphenol, 4,4'-isopropylidene di(2-methylphenol), 4,4-di(4-hydroxyphenyl)valeric acid, resorcinol, hydroquinone, pyrogallol, phloroglucine, p-, m-, o-hydroxybenzoic acid, 3,5-di-(α-methylbenzyl)salicylic acid, 3,5-di(α,α-dimethylbenzyl)salicylic acid, salicylosalicylic acid, alkyl gallate, gallic acid, hydroxyphthalic acid, 1-hydroxy-2-naphthoic acid or phenol/formaldehyde prepolymers, which can also be modified with zinc. Of the carboxylic acids listed, the salicylic acid derivatives are preferred and are preferably used as zinc salts. Particularly preferred zinc salicylates are described in EP-A No. 181,283 or DE-A No. 2,242,250.

Very suitable components (C) are also organic complexes of zinc thiocyanate and in particular an antipyrine complex of zinc thiocyanate or a pyridine complex of zinc thiocyanate, such as described in EP-A No. 97,620.

Preferred components (C) include a zinc salt of a salicylic acid derivative, a metal-free phenolic compound, a phenolic resin, a zinc salt of a phenolic resin or an acid clay.

The developers can additionally also be used in a mixture with pigments which are unreactive per se or little reactive or further auxiliaries such as silica gel or light stabilizers, for example 2-(2'-hydroxyphenyl)benzotriazoles, benzophenones, cyanoacrylates, phenyl salicylates. Examples of these pigments are: talcum, titanium dioxide, alumina, aluminium hydroxide, zinc oxide, chalk, clays such as kaolin, and organic pigments, for example urea/formaldehyde condensation products (BET surface area 2–75 $m^2/g$) or melamine/formaldehyde condensation products.

The mixing ratio of component (C) to components (A) and (B) depends on the type of the three components, the nature of the colour formation, the colour reaction temperature and, of course, also of the desired colour concentration. Satisfactory results are obtained by using the colour-developing component (C) in amounts of 0.1 to 100 parts by weight per part of components (A) and (B) combined.

For use in the pressure-sensitive recording material, not only component (A) but also component (B) are preferably dissolved together or even separately in an organic solvent, and the solutions obtained are advantageously encapsulated by processes, as described, for example in U.S. Pat. Nos. 2,712,507, 2,800,457, 3,016,308, 3,429,827 and 3,578,605 or in British Patent Nos. 989,264, 1,156,725, 1,301,052 or 1,355,124. Microcapsules which are formed by interfacial polymerization, for example polyester, polycarbonate, polysulfonamide, polysulfonate, but in particular polyamide or polyurethane capsules, are also suitable. In some cases, only component (A) needs to be encapsulated. Encapsulation is usually required to separate components (A) and (B) from component (C) and thus prevent premature colour formation. The latter can also be achieved by incorporating components (A) and (B) in foam-, sponge- or honeycomb-like structures.

Examples of suitable solvents are preferably non-volatile solvents, for example halogenated benzene, diphenyls or paraffin, for example chlorinated paraffin, trichlorobenzene, monochlorodiphenyl, dichlorodiphenyl or trichlorodiphenyl; esters, for example dibutyl adipate, dibutyl phthalate, dioctyl phthalate, butyl benzyl adipate, trichloroethyl phosphate, trioctyl phosphate, tricresyl phosphate; aromatic ethers such as benzyl phenyl ethers; hydrocarbon oils, such as paraffin oil or kerosin, for example isopropyl-, isobutyl-, sec-butyl- or tert-butyl-alkylated derivatives or diphenyl, naphthalene or terphenyl, dibenzyltoluene, partially hydrogenated terphenyl, mono- to tetra-$C_1$–$C_3$alkylated diphenylalkanes, dodecylbenzene, benzylated xylenes, or further chlorinated or hydrogenated fused aromatic hydrocarbons. Often, mixtures of various solvents, in particular mixtures of paraffin oils or kerosin and diisopropylnaphthalene or partially hydrogenated terphenyl, are used to achieve optimum solubility for the colour formation, a rapid and deep coloration and a viscosity which is favourable for microencapsulation.

The microcapsules containing components (A) and (B) can be used for preparing pressure-sensitive copying materials of a wide range of known types. The various systems differ mainly in the arrangement of the capsules, the colour reactants and the substrate.

An advantageous arrangement is one in which the encapsulated components (A) and (B) are present in the form of a layer on the back of a transfer sheet and the electron acceptor (component (C)) is present in the form of a layer on the front of a receptor sheet. However, the arrangement can also be reversed. A different arrangement of the components is one in which the microcapsules containing components (A) and (B) and the developer (component (C)) are present in or on the same sheet in the form of one or more individual layers or are present in the paper pulp.

To obtain the desired colour, the capsule material which contains components A and B can be mixed with further capsules which contain conventional colour formers. Similar results are obtained by encapsulating components A and B together with one or more of the conventional colour formers.

The capsules are preferably attached to the substrate by means of a suitable binder. Since paper is the preferred substrate, this binder mainly comprises paper coating agents, for example gum arabic, polyvinyl alcohol, hydroxymethylcellulose, casein, methylcellulose, dextrin, starch, starch derivatives or polymer latices. The latter are, for example, butadiene/styrene copolymers or acrylic homopolymers or copolymers.

The papers which are used are not only standard papers made of cellulose fibres but also papers in which the cellulose fibres are replaced (partially or completely) by fibres made of synthetic polymers. The substrate can also be a plastic sheet.

Preferably, the copying material can also be such that it contains a capsule-free layer containing components (A) and (B) and a colour-developing layer containing at least one inorganic metal salt, in particular halides or nitrates, for example zinc chloride, tin chloride, zinc nitrate or a mixture thereof, as the colour developer (component (C)).

The ternary colour formation system used according to the invention and consisting of components (A), (B) and (C) is also suitable for preparing a heat-sensitive recording material for thermography, in which components (A), (B) and (C) make contact upon heating, as a result of which colour formation takes place and recorded images are left behind on the substrate.

The heat-sensitive recording material usually contains at least one substrate, components (A), (B) and (C) and, if necessary, also a binder and/or wax. If desired, activators or sensitizers can also be present in the recording material.

Thermoreactive recording systems comprise, for example, heat-sensitive recording and copying materials and papers. These systems are used, for example for recording information, for example in electronic computers, printers, facsimile machines or copiers or in medical and technical recording and measuring instruments, for example electrocardiographs. The image formation (marking) can also take place manually by means of a heated pen. A further means for producing markings by means of heat are laser beams.

The thermoreactive recording material can also be structured in such a way that components (A) and (B)

are dissolved or dispersed in a binder layer, and, in a second layer, the developer (component (C)) is dissolved or dispersed in the binder. Another possibility is one in which all three components are dispersed in the same layer. The layer or layers are softened or melted in specific areas by means of heat, as a result of which components (A), (B) and (C) make contact with one another at those points where heat has been applied, and the desired colour develops immediately.

The thermoreactive recording material can also contain component (A) and/or (B) in encapsulated form.

Preferably, meltable, film-forming binders are used for preparing the heat-sensitive recording material. These binders are usually water-soluble, while components (A), (B) and (C) are insoluble in water. The binder should be capable of dispersing the three components at room temperature and fixing them on the substrate.

Water-soluble or at least water-swellable binders are, for example, hydrophilic polymers, such as polyvinyl alcohol, alkali metal polyacrylates, hydroxyethylcellulose, methylcellulose, carboxymethylcellulose, polyacrylamide, polyvinylpyrrolidone, carboxylated butadiene/styrene copolymers, gelatin, starch or esterified corn starch.

In the case where components (A), (B) and (C) are present in two or three different layers, water-insoluble binders, that is, binders which are soluble in nonpolar or only weakly polar solvents, for example natural rubber, synthetic rubber, chlorinated rubber, polystyrene, styrene/butadiene mixed polymers, polymethyl acrylates, ethylcellulose, nitrocellulose and polyvinylcarbazole can be used. However, the preferred arrangement is such that all three components are present in one layer in a water-soluble binder.

To ensure the stability of the heat-sensitive recording material or the density of the developed image, the material can be provided with an additional protective layer. This type of protective layer usually consists of water-soluble and/or water-insoluble resins which are conventional polymers or aqueous emulsions of these polymers.

Specific examples of water-soluble polymers are polyvinyl alcohol, starch, starch derivatives, cellulose derivatives, such as methoxycellulose, hydroxyethylcellulose, carboxymethylcellulose, methylcellulose or ethylcellulose, sodium polyacrylate, polyvinylpyrrolidone, polyacrylamide/acrylic ester copolymers, acrylamide/acrylic ester/methacrylic ester copolymers, alkali metal salts of styrene/maleic anhydride copolymers, alkali metal salts of isobutene/maleic anhydride copolymers, polyacrylamide, sodium alginate, gelatin, casein, water-soluble polyesters or carboxyl-modified polyvinyl alcohol.

If desired, for example, the following water-insoluble resins can be used in the protective layer in combination with the water-soluble polymer resins mentioned: polyvinyl acetate, polyurethane, styrene/butadiene copolymers, polyacrylic acid, polyacrylic ester, vinyl chloride/vinyl acetate copolymers, polybutyl methacrylate, ethylene/vinyl acetate copolymers and styrene/butadiene/acrylic derivative copolymers.

Not only the thermoreactive but also the resin layers can contain further additives. To improve the whiteness or the thermal printing head suitability of the recording material and to prevent the heated pen or plate from becoming glued on, these layers can contain, for example, antioxidants, light stabilizers, solubilizers, talcum, titanium dioxide, zinc oxide, alumina, aluminium hydroxide, calcium carbonate (e.g. chalk), clays or even organic pigments, for example urea/formaldehyde polymers. To restrict the colour formation to a limited temperature range, it is possible to add substances such as urea, thiourea, diphenylthiourea, acetamide, acetanilide, benzenesulfanilide, ethylene-bis(stearamide), stearamide, phthalic anhydride, benzylbenzyloxybenzoate, metal stearates, for example zinc stearate, phthalonitrile, dimethyl terephthalate, benzyldiphenyl, dibenzylterephthalate, dibenzyl isophthalate or other suitable meltable products which induce the simultaneous melting of the colour former components and of the developer.

Preferably, thermographic recording materials contain waxes, for example carnauba wax, montan wax, paraffin wax, polyethylene wax, condensation products of higher fatty acid amides and formaldehyde or condensation products of higher fatty acids and ethylenediamine.

To improve the applicability of the thermochromatic materials, the three components (A), (B) and (C) can be microencapsulated. For this purpose, any desired abovementioned processes which are known per se for the encapsulation of colour formers or other active substances in microcapsules can be used.

In the preparation procedures and examples which follow, the percentages given are by weight unless stated otherwise. Parts are parts by weight.

PREPARATION PROCEDURES

Procedure A: 19.3 g of 3-(1'-ethyl-2'-methylindol-3'-yl)-3-hydroxy-4,5,6,7-tetrachlorophthalide (or the tautomer of the corresponding keto acid) are added at 25° C. with stirring to 20 ml of acetic anhydride. The mixture is heated to 117° C., this temperature is maintained for 2½ hours, and 15 ml of glacial acetic acid are added, and the resulting product is filtered off at 80° C. The residue is washed with petroleum ether and dried in vacuo. This gives 12.4 g of the lactol ester of the formula

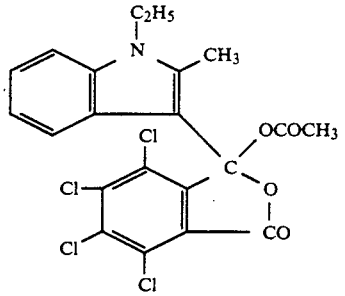

(5)

in the form of white crystals. After recrystallization from toluene/acetic anhydride, the pure product has a melting point of 187°–188° C. (decomposition).

In the IR spectrum, the acetate CO band appears at 1770 $cm^{-1}$ and the lactone CO band at 1790 $cm^{-1}$.

Procedure B: The procedure as described in A is repeated, except that 25 ml of propoionic anhydride are used instead of acetic anhydride and the temperature is maintained at 110° C. for 3 hours, to give, after recrystallization from toluene, 3.8 g of the lactol ester of the formula

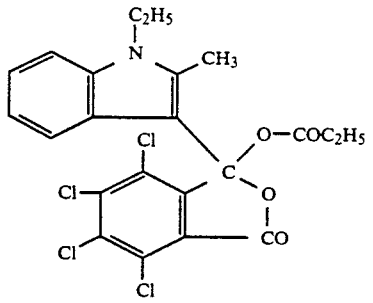

(6)

of melting point 197°–198° C.

Procedure C: 26.5 g of 3-(1'-n-octyl-2'-methylindol-3'-yl)-3-hydroxy-4,5,6,7-tetrachlorophthalide (or the tautometer of the corresponding keto acid) are heated in 30 ml of acetic anhydride to 80°–85° C. and stirred at this temperature for 3 hours. The product precipitates from the resulting solution upon cooling, after which it is filtered off. The product is washed with glacial acetic acid and petroleum ether. After recrystallization from toluene, 17.2 g of the lactol ester of the formula

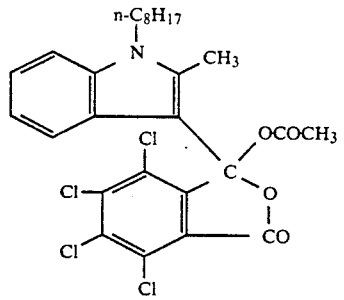

(7)

of melting point 146°–148° C. (dec.) are obtained.

Procedure D: The procedure as described in A is repeated, except that 24.6 g of 3-(1'-methyl-2'-phenylindol-3'-yl)-3-hydroxy-4,5,6,7-tetrachlorophthalide are used instead of the phthalide described there, to give, after recrystallization from toluene, 14.3 g of the lactol ester of the formula

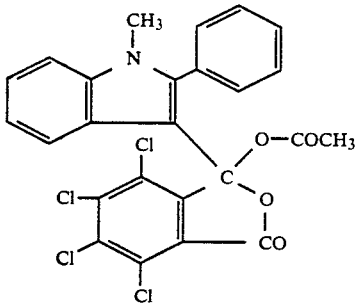

(8)

of melting point 220°–221° C. (dec.).

Procedure E: 4.5 g of 2-(2'-ethoxy-4'-diethylaminobenzoyl)-3,4,5,6-tetrachlorobenzoic acid are dissolved in 15 g of acetic anhydride at 45° C., and the mixture is maintained at 65°–70° C. for 7 hours. The product crystallizes upon cooling and is filtered off at 20° C. After drying, 3 g of a lactol ester of the formula

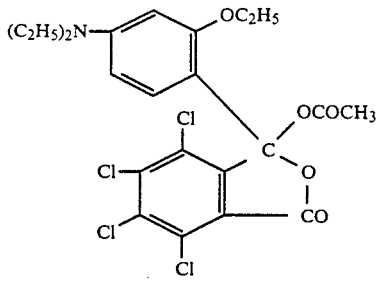

(9)

are obtained. After purification with petroleum ether, this compound has a melting point of 185°–186° C. with decomposition.

Procedure F: 4.8 g of the lactol ester of the formula (5) according to Procedure A are refluxed in 100 ml of methanol for 1 hour with stirring. After cooling, the product is filtered off to give 4 g of a phthalide compound of the formula

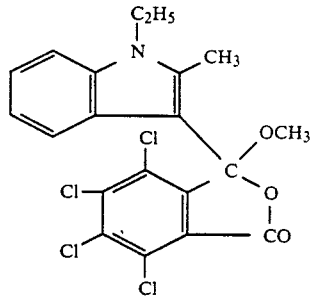

(10)

After recrystallization from toluene and methanol, the product melts at 184°–185° C.

Procedure G: The procedure as described in F is repeated, except that 50 ml of benzyl alcohol are used instead of methanol, to give a phthalide compound of the formula

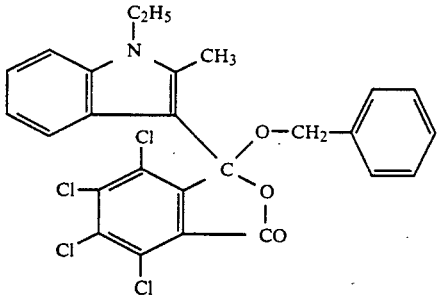

(11)

m.p. 183°–184° C.

Procedure H: The procedure as described in C is repeated, except that 30 ml of propionic anhydride are used instead of acetic anhydride, the reaction temperature is maintained at 75°–78° C. for 2½ hours, and the mixture is diluted before filtration with 10 ml of propionic anhydride, to give, after drying, 18.8 g of the lactol ester of the formula

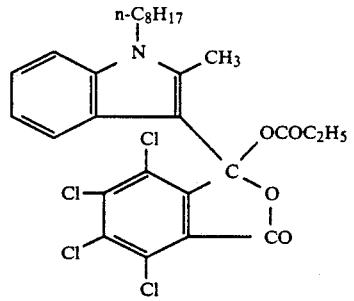

(12)

of melting point 154°-155.5° C. (dec.).

Procedure I: 36.9 g of 2-(4-dibutylamino-2'-hydroxybenzoyl)benzoic acid are stirred in 240 ml of acetone and 40 ml of diethyl sulfate at 35° C. A solution of 16.8 g of potassium hydroxide in 50 ml of water is added dropwise at 35° C. (±2° C.) over a period of 4 hours, and the reaction is then completed at this temperature over a period of 20 hours. Another 11.2 g of potassium hydroxide dissolved in 50 ml of water are added, and the acetone is removed completely by azeotropic distillation up to a flash temperature of 96° C. Stirring is continued for another 2 hours at 90°-95° C. After cooling to 10° C., 18 ml of concentrated hydrochloric acid are added dropwise, resulting in the precipitation of the product. The mixture is stirred at 15°-20° C. for 16 hours, the product is filtered off and washed with water. After drying, 39.2 g of the compound of the formula

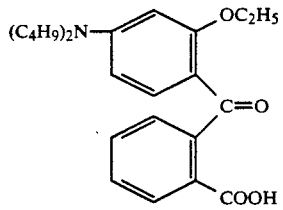

(ii)

of melting point 166°-168° C. are obtained.

11.9 g of the compound of the formula (ii) are stirred in 36 ml of acetic anhydride, the mixture is heated and maintained at 65°-70° C. for ½ an hour. The resulting solution is poured into a mixture of 150 ml of toluene and 360 ml of 15% sodium carbonate solution with vigorous stirring, the aqueous phase is separated off, the toluene phase is washed with water, dried over sodium sulfate and concentrated under reduced pressure. This gives 13 g of the compound of the formula

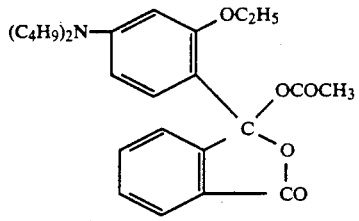

(13)

in the form of an orange-coloured oil.

Procedure K: 17 g of 2-(4'-diethylamino-2'-ethoxybenzoyl)benzoic acid are stirred in 60 ml of acetic anhydride at 65°-70° C. for 45 minutes, resulting in an orange-coloured solution. This solution is poured into a mixture of 250 ml of toluene and 600 ml of 15% sodium carbonate solution with thorough stirring. The alkaline aqueous phase is separated off, the toluene phase is washed with water, dried with sodium sulfate and evaporated to dryness. The residue is recrystallized from toluene/petroleum ether 1:1 and gives, after drying, 13.2 g of the compound of the formula

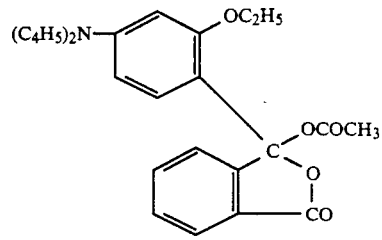

(14)

of melting point 95°-97° C. with decomposition.

Procedure L: 45.2 g of benzoic anhydride are melted at 50° C. At this temperature, 8.9 g of 3-(1'-ethyl-2'-methylindol-3'-yl)-3-hydroxy-4,5,6,7-tetrachlorophthalide (or the tautomer of the corresponding keto acid) are added with stirring, the mixture is heated to 100° C. and maintained at this temperature for 3 hours. It is cooled to 50° C., 25 ml of methyl ethyl ketone and 10 ml of petroleum ether are added, and the product is allowed to complete crystallization at 20° C. for 2 hours. It is filtered off and dried to give 2.9 g of the compound of the formula

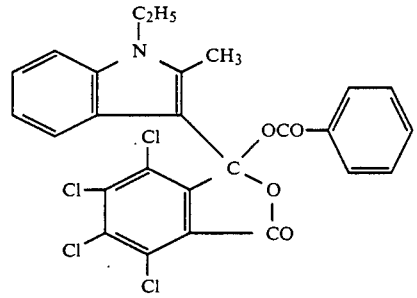

(15)

which, after recrystallization from methyl ethyl ketone, precipitates in pure form and has a melting point of 129°-131° C.

EXAMPLE 1

Dispersion A is prepared by milling 1.43 g of 3-(1'-ethyl-2'-methylindol-3'-yl)-3-acetoxy-4,5,6,7-tetrachlorophthalide of the formula (5), 5 g of a 10% aqueous solution of polyvinyl alcohol (Polyviol VO3/140) and 2.9 g of water together with glass beads to a particle size of 2-4 μm.

A dispersion B is prepared by milling 0.57 g of 2-phenylindole, 2 g of a 10% aqueous solution of polyvinyl alcohol (Polyviol VO3/140) and 1.1 g of water to a particle size of 2-4 μm.

A dispersion C is prepared by milling 6 g of the zinc salicylate according to EP-A No. 181,283, Example 1, 21 g of a 10% aqueous solution of polyvinyl alcohol (Polyviol VO3/140) and 12 g of water together with glass beads to a particle size of 2-4 μm.

Dispersions A, B and C are then mixed and applied to a paper having a weight per unit area of 50 g/m² by means of a blade in such a manner that the applied material corresponds to a dry weight of 4 g/m². When the paper is used in a facsimile machine (Infotec 6510) a lightfast deep violet colour develops.

The 3-(1'-ethyl-2'-methylindol-3'-yl)-3-acetoxy-4,5,6,7-tetrachlorophthalide used in Example 1 is prepared according to Procedure A.

EXAMPLE 2

The procedure as described in Example 1 is repeated, replacing the 2-phenylindole in dispersion B of Example 1 by 0.41 g of 3-amino-4-methoxytoluene, to give a lightfast deep yellow colour.

EXAMPLE 3

The procedure as described in Example 1 is repeated, replacing the 2-phenylindole in dispersion B of Example 1 by 0.53 g of 1-phenyl-3-methyl-5-pyrazolone, to give a lightfast red colour.

EXAMPLE 4

The procedure as described in Example 1 is repeated, replacing the phthalide compound of the formula (5) in dispersion A of Example 1 by an equimolar amount of the phthalide compound of the formula (7) according to Procedure C, to give a violet colour.

EXAMPLE 5

The procedure as described in Example 1 is repeated, replacing the phthalide compound of the formula (5) in dispersion A of Example 1 by an equimolar amount of the phthalide compound of the formula (8) according to Procedure D, to give a violet colour.

EXAMPLE 6

The procedure as described in Example 1 is repeated, replacing the phthalide compound of the formula (5) in dispersion A of Example 1 by an equimolar amount of the phthalide compound of the formula (6) according to Procedure B, to give a violet colour.

EXAMPLE 7

The procedure as described in Example 1 is repeated, replacing the phthalide compound of the formula (5) in dispersion A of Example 1 by an equimolar amount of the phthalide compound of the formula (12) according to Procedure H, to give a violet colour.

EXAMPLE 8

The procedure as described in Example 1 is repeated, replacing the phthalide compound of the formula (5) in dispersion A of Example 1 by an equimolar amount of the phthalide compound of the formula (15) according to Procedure L, to give a violet colour.

EXAMPLE 9

The procedure as described in Example 1 is repeated, replacing the phthalide compound of the formula (5) in dispersion A of Example 1 by an equimolar amount of the phthalide compound of the formula (9) according to Procedure E, to give a blue colour.

EXAMPLE 10

The procedure as described in Example 1 is repeated, replacing the phthalide compound of the formula (5) in dispersion A of Example 1 by an equimolar amount of the phthalide compound of the formula (7) and the 2-phenylindole in dispersion B of Example 1 by an equimolar amount of 3-methyl-6-dimethylaminoindole, to give a green colour.

EXAMPLE 11

The procedure as described in Example 1 is repeated, replacing the zinc salicylate in dispersion C of Example 1 by 6 g of the antipyrine complex of zinc thiocyanate (according to EP-A No. 97,620, Example 17). A lightfast violet colour develops.

EXAMPLE 12

A solution of 2.3 g of 3-(1'-ethyl-2'-methylindol-3'-yl)-3-acetoxy-4,5,6,7-tetrachlorophthalide of the formula (5) in 98 g of diisopropylnaphthalene is microencapsulated in a known manner by coacervation with gelatin and gum arabic. This gives capsule material A.

A capsule material B is prepared by microencapsulating a solution of 1 g of 2-phenylindole in 99 g of diisopropylnaphthalene likewise by coacervation with gelatin and gum arabic.

The two capsule materials A and B are mixed with starch solution and brushed onto a sheet of paper. A second sheet of paper is coated with activated clay as the colour developer. The two sheets of paper are placed with their coated sides on top of each other. Writing by hand or a typewriter applies pressure to the top sheet, as a result of which a blue copy which has good lightfastness develops on the lower sheet coated with the developer.

EXAMPLE 13

The procedure as described in Example 12 is repeated, using a capsule material C consisting of an encapsulated solution of 0.84 g of 3-methyl-6-dimethylaminoindole in 99 g of diisopropylnaphthalene instead of the capsule material B of Example 12, to give, after writing, a blue-grey lightfast copy.

EXAMPLE 14

The procedure as described in Example 12 is repeated, using a capsule material D consisting of an encapsulated solution of 0.66 g of 3-amino-4-methoxytoluene in 99 g of diisopropylnaphthalene instead of the capsule material B of Example 12, to give, after writing, a yellow copy.

EXAMPLE 15

The procedure as described in Example 12 is repeated, using a capsule material E consisting of an encapsulated solution of 0.84 g of 1-phenyl-3-methyl-5-pyrazolone in 99 g of diisopropylnaphthalene instead of the capsule material B of Example 12, to give, after writing, a red copy.

EXAMPLE 16

The procedure as described in Example 12 is repeated, using a capsule material F consisting of an encapsulated solution of 1 g of 3-phenyl-4-methylindolizine in 99 g of diisopropylnaphthalene instead of the capsule material B of Example 12, to give, after writing, a blue copy.

EXAMPLE 17

3.2 g of 3-(1'-n-octyl-2'-methylindol-3'-yl)-3-acetoxy-4,5,6,7-tetrachlorophthalide of the formula (7) and 1.1 g of 2-phenylindole are dissolved together in a mixture of 130 g of diisopropylnaphthalene and 66 g of kerosine and microencapsulated by coacervation with gelatin and gum arabic. The capsule material is mixed with starch solution and brushed onto a sheet of paper. A second sheet of paper is coated on its front with acid-modified bentonite as the developer. The papers are placed with the coated sides on top of each other and pressure is applied by hand- or typewriter-writing, to give a blue lightfast copy on the sheet coated with the developer.

EXAMPLE 18

3.2 g of 3-(1'-n-octyl-2'-methylindol-3'-yl)-3-acetoxy-4,5,6,7-tetrachlorophthalide of the formula (7), 1.1 g of 2-phenylindole and 1 g of the yellow colour former of the formula.

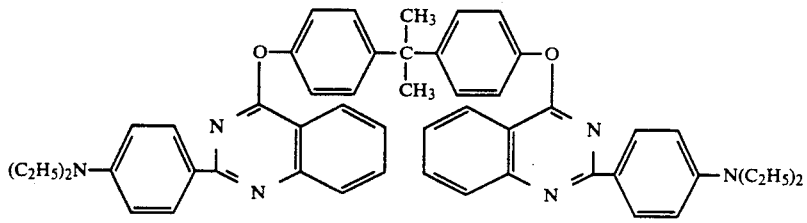

are dissolved together in a mixture of 130 g of diisopropylnaphthalene and 66 g of kerosine and microencapsulated by coacervation with gelatin and gum arabic. The capsule material is mixed with starch solution and brushed onto a sheet of paper. A second sheet of paper is coated on its front with acid-modified betonite as the developer. The papers are placed with the coated sides on top of each other and pressure is applied by hand- or typewriter-writing, to give a olive-grey copy on the sheet coated with the developer.

EXAMPLE 19

A solution of 2 g of 2-N-methyl-N-phenylamino-6-N-ethyl-N-p-tolylaminofluoran in 98 g of diisopropylnaphthalene and a common solution of 0.235 g of 2-methylindole and 0.875 g of 3-(1'-ethyl-2'-methylindol-3'-yl)-3-acetoxy-4,5,6,7-tetrachlo rophthalide of the formula (5) in 49 g of diisopropylnaphthalene are mixed and microencapsulated in a known manner by coacervation with gelatin and gum arabic. The capsule material is mixed with starch solution and brushed onto a sheet of paper. A second sheet of paper is coated on the front with acid-modified bentonite as a developer. The papers are placed with the coated sides on top of each other and pressure is applied by hand- or typewriter-writing, to give a black copy on the sheet coated with the developer.

EXAMPLE 20

A solution of 2 g of 2-phenylamino-3-methyl-6-diethylaminofluoran in 98 g of diisopropylnaphthalene and a solution of 0.58 g of 3-methyl-6-dimethylaminoindole and 1.6 g of 3-(1'-ethyl-2'-methylindol-3'-yl)-3-acetoxy-4,5,6,7-tetrachlorophthalide of the formula (5) in 98 g of diisopropylnaphthalene are mixed and encapsulated in a known manner, and the capsule material is brushed onto the back of a sheet of paper. This CB sheet is placed on top of a CF sheet which contains activated clay or zinc salicylate as coreactant, and upon writing by hand or typewriter, a grey copy whose absorption extends into the near infrared and which has good lightfastness develops on the CF sheet.

EXAMPLE 21

1.4 g of 3,3-bis(4'-dimethylaminophenyl)-6-dimethylaminophthalide, 1.0 g of N-butylcarbazol-3-yl-bis(4'-N-methyl-N-phenylaminophenyl)methane, 0.5 g of 3,3-bis(N-n-octyl-2'-methylindol-3-yl)-phthalide, 0.34 g of 3-amino-4-methoxytoluene and 1.3 g of 3-(4'-diethylamino-2'-ethoxyphenyl)-3-acetoxy-4,5,6,7-tetrachlorophthalide of the formula (9) are each dissolved separately in diisopropylnaphthalene, mixed and microencapsulated in a known manner. The paper coated with this capsule material (=CB sheet) is placed on top of a paper coated with bentonite (=CF sheet). Upon applying pressure by hand- or typewriter-writing, a lightfast black copy develops on the CF sheet.

In exactly the same manner as described in Example 12, the colours mentioned in columns 4 and 5 of the table, depending on the developer used (active clay or zinc salicylate according to EP-A 181,283, Example 1) are obtained by using the capsule materials prepared by means of the corresponding components listed in columns 2 and 3.

TABLE

| 1<br>Example | 2<br>Capsule material A<br>Component (A) | 3<br>Capsule material B<br>Component (B) | 4<br>Active clay<br>Component (C) | 5<br>Zinc salicylate<br>Component (C) |
|---|---|---|---|---|
| 22 | Phthalide of the formula (5) | 2-Methylindole | red | violet |
| 23 | Phthalide of the formula (5) | 1-Methyl-2-phenyl-indole | violet | violet |
| 24 | Phthalide of the formula (5) | 2-(4'-Methoxyphenyl)-5-methoxyindole | blue | violet |
| 25 | Phthalide of the formula (7) | 1-n-Octyl-2-methyl-indole | violet | violet |
| 26 | Phthalide of the formula (8) | 1-Methyl-2-phenyl-indole | blue | violet |
| 27 | Phthalide of the formula (9) | 2-Phenylindole | blue | blue |
| 28 | Phthalide of the formula (9) | 2-Methylindole | blue | blue |
| 29 | Phthalide of the formula (9) | 3-Amino-4-methoxy-toluene | yellow | yellow |

TABLE-continued

| 1 Example | 2 Capsule material A Component (A) | 3 Capsule material B Component (B) | 4 Active clay Component (C) | 5 Zinc salicylate Component (C) |
|---|---|---|---|---|
| 30 | Phthalide of the formula (9) | 1-Ethyl-2-methyl-indole | blue | blue |
| 31 | Phthalide of the formula (13) | 2-Phenylindole | blue | blue |
| 32 | Phthalide of the formula (13) | 1,1-Bis-(1'-ethyl-2'-methylindol-3'-yl)-ethylene | violet | violet |
| 33 | Phthalide of the formula (14) | 2-Phenylindole | blue-grey | blue |
| 34 | Phthalide of the formula (14) | 3-Amino-4-methoxy-toluene | yellow | yellow |
| 35 | Phthalide of the formula (14) | 1-n-Octyl-2-methylindole | violet | blue |
| 36 | Phthalide of the formula (14) | 2-Methylindole | violet | blue |
| 37 | Phthalide of the formula (14) | 2-n-Octylamino-6-diethylaminofluoran | brown-red | red |
| 38 | Phthalide of the formula (15) | 2-Phenylindole | blue | violet |
| 39 | Phthalide of the formula (15) | 2-Methylindole | red | violet |

What is claimed is:

1. A pressure-sensitive or heat-sensitive recording material comprising a substrate and a color reactant system in which the color reactant system comprises (A) a polycyclic compound of the formula

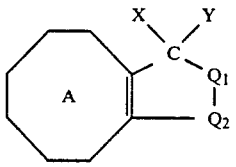

(1)

in which

X is a monocyclic or polycyclic aromatic or heteroaromatic radical,

Y is a substituent detachable as an anion, $Q_1$ is —O—, —S—, >N—R or >N—NH—R, $Q_2$ is $—CH_2—$, —CO—, —CS— or $—SO_2—$, R is hydrogen, $C_1$–$C_{12}$alkyl, $C_5$–$C_{10}$cycloalkyl, aryl or aralkyl, and ring A is an aromatic or heterocyclic radical having 6 ring atoms, which can have an aromatic fused ring, it being possible for both ring A and the fused ring to be substituted, (B) an organic condensation component and (C) a colour-developing component.

2. A material according to claim 1, wherein in formula (1) X is a pyrrolyl, thienyl, indolyl, carbazolyl, acridinyl, benzofuranyl, benzothienyl, naphthothienyl, phenothiazinyl, indolinyl, julolidinyl, kairolyl, dihydroquinolyl or tetrahydroquinolyl radical.

3. A material according to claim 1, wherein in formula (1) X is a pyrrolyl, indolyl, carbazolyl, indolinyl, julolidinyl, kairolyl, dihydroquinolyl or tetrahydroquinolyl radical.

4. A material according to claim 1, wherein in formula (1) X is a substituted 2-pyrrolyl, 3-pyrrolyl or 3-indolyl radical.

5. A material according to claim 1, wherein in formula (1) X is a N-$C_1$–$C_8$-alkyl-2-methylindol-3-yl, N-$C_2$–$C_4$-alkanoyl-2-methylindol-3-yl, 2-phenylindol-3yl or N-$C_1$–$C_8$-alkyl-2-phenylindol-3-yl radical.

6. A material according to claim 1, wherein in formula (1) X is a phenyl or naphthyl radical which is unsubstituted or substituted by halogen, cyano, lower alkyl, $C_5$–$C_6$cycloalkyl, $C_1$–$C_8$acyl, $—NR_1R_2$, $—OR_3$ or $—SR_3$, in which $R_1$, $R_2$ and $R_3$, independently of one another, are each hydrogen, unsubstituted or halogen-, hydroxyl-, cyano- or lower alkoxy-substituted alkyl having a maximum number of 12 carbon atoms, acyl having 1 to 8 carbon atoms, cycloalkyl having 5 to 10 carbon atoms or phenalkyl or phenyl which is unsubstituted or ring-substituted by halogen, cyano, lower alkyl, lower alkoxy, lower alkoxycarbonyl, —NX'X" or 4-NX'X"-phenylamino, in which X' and X", independently of one another, are hydrogen, lower alkyl, cyclohexyl, benzyl or phenyl, or $R_1$ and $R_2$ together with the nitrogen atom linking them form a five- or six-membered heterocyclic radical.

7. A material according to claim 1, wherein in formula (1) X is a substituted phenyl radical of the formula

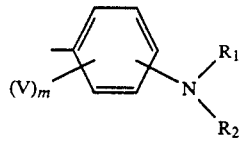

(1a)

or

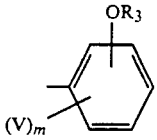

(1b)

in which $R_1$, $R_2$ and $R_3$, independently of one another, are each hydrogen, unsubstituted or halogen-, hydroxyl-, cyano- or lower alkoxy-substituted alkyl having a maximum number of 12 carbon atoms, acyl having 1 to 8 carbon atoms, cycloalkyl having 5 to 10 carbon atoms or phenalkyl or phenyl which is unsubstituted or ring-substituted by halogen, cyano, lower alkyl, lower alkoxy, lower alkoxycarbonyl, —NX'X" or 4NX'X"-phenylamino, in which X' and X", independently of one another, are hydrogen, lower alkyl, cyclohexyl, benzyl or phenyl, or $R_1$ and $R_2$ together with the nitrogen atom linking them form a five- or six-membered heterocyclic radical and V is hydrogen, halogen, lower alkyl, $C_1$–$C_{12}$alkoxy, $C_1$–$C_{12}$acyloxy, benzyl, phenyl, benzyloxy, phenyloxy, halogen-, cyano-, lower alkyl- or lower alkoxy-substituted benzyl or benzyloxy, or is the group $—NT_1T_2$, $T_1$ and $T_2$, independently of one another, are each hydrogen, lower alkyl, $C_5$–$C_6$cycloalkyl, unsubstituted or halogen-, cyano-, lower alkyl- or lower alkoxy-substituted benzyl, or acyl having 1 to 8 carbon atoms and $T_1$ is also unsubstituted or halogen-, cyano-, lower alkyl- or lower alkoxy-substituted phenyl and m is 1 or 2.

8. A material according to claim 1, wherein in formula (1) Y is halogen, an aliphatic, cycloaliphatic, araliphatic, aromatic or heterocyclic ether group or an acyloxy group.

9. A material according to claim 1, wherein in formula (1) Y is an acyloxy group of the formula $$R'(NH—)_{n-1}—Q'—O— \quad (1c)$$

in which R' is unsubstituted or substituted $C_1$–$C_{22}$alkyl, cycloalkyl, aryl, aralkyl or heteroaryl, Q' is —CO— or —$SO_2$— and n is 1 or 2.

10. A material according to claim 1, wherein in formula (1) Y is an acyloxy group of the formula R''—CO—O— in which R'' is lower alkyl or phenyl.

11. A material according to claim 1, wherein in formula (1) $Q_1$ is oxygen and $Q_2$ is —CO—.

12. A material according to claim 1, wherein in formula (1) ring A is a substituted or unsubstituted benzene, naphthalene, pyridine, pyrazine, quinoxaline or quinoline ring.

13. A material according to claim 1, wherein in formula (1) ring A is an unsubstituted or halogen-substituted benzene ring.

14. A material according to claim 1, wherein component (A) is a lactone compound of the formula

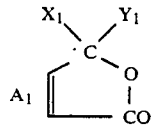

(2)

in which $A_1$ is a benzene or pyridine ring which is unsubstituted or substitued by halogen, cyano, lower alkyl, lower alkoxy or lower dialkylamino, $Y_1$ is halogen or acyloxy and $X_1$ is a 3-indolyl radical of the formula

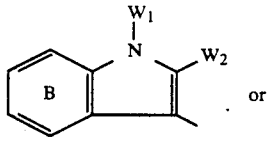

(2a)

or a substituted phenyl radical of the formula

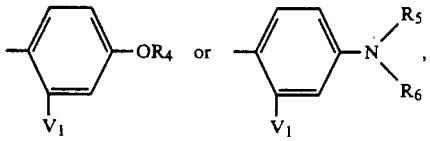

(2b) (2c)

in which $W_1$ is hydrogen, unsubstituted or cyano- or lower alkoxy-substituted $C_1$–$C_8$alkyl, acetyl, propionyl or benzyl, $W_2$ is hydrogen, lower alkyl, or phenyl, $R_4$, $R_5$ and $R_6$, independently of one other, are each unsubstituted or hydroxy-, cyano- or lower alkoxy-substituted alkyl having a maximum number of 12 carbon atoms, $C_5$–$C_6$cycloalkyl, benzyl, phenethyl or phenyl, or ($R_5$ and $R_6$) together with the nitrogen atom linking them are pyrrolidino, piperidino or morpholino, $V_1$ is hydrogen, halogen, lower alkyl, $C_{1-C8}$alkoxy, benzyloxy or the group —$NT_3T_4$, $T_3$ and $T_4$, independently of one another, are each hydrogen, lower alkyl, lower alkylcarbonyl or unsubstituted or halogen-, methyl-or methoxy-substituted benzoyl, and ring B is unsubstituted or substituted by halogen, lower alkyl or lower dialkylamino.

15. A material according to claim 14, wherein in formula (2) $Y_1$ is lower alkylcarbonyloxy or benzoyloxy.

16. A material according to claim 14, wherein in formula (2) $X_1$ is a 3-indolyl radical of the formula 2(a) in which $W_1$ is $C_1$–$C_8$alkyl, $W_2$ is methyl or phenyl, and $Y_1$ is lower alkylcarbonyloxy.

17. A material according to claim 1, wherein component (A) is a lactone compound of the formula

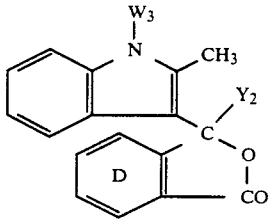

(3)

in which ring D is unsubstituted or chlorine-tetrasubstituted, $Y_2$ is acetoxy or benzoyloxy and $W_3$ is $C_1$–$C_8$-alkyl.

18. A material according to claim 1, wherein component (A) is a lactone compound of the formula

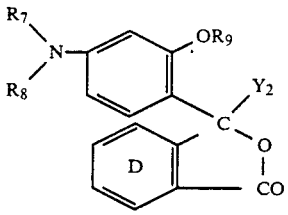

(4)

in which ring D is unsubstituted or chlorine-tetrasubstituted, $Y_2$ is acetoxy or benzoyloxy and $R_7$, $R_8$ and $R_9$ are each lower alkyl.

19. A material according to claim 1, wherein the condensation component (B) is an N-substituted aminophenylethylene, N-substituted aminophenylstyrene, acylacetarylamide, monohydric or polyhydric phenol, phenol ether, 3-aminophenol ether, aniline, naphthylamine, diarylamine, naphthol, naphtholcarboxanilide, aminopyrazole, pyrazolone, thiophene, thionaphthene, phenothiazine, aminothiazole, acridine, pyridone, indole, carbazole, kairoline, indolizine, julolidine, morpholine, pyrrolidine, piperidine, piperazine, indoline, quinolone, pyrimidone, barbituric acid, benzomorpholine, dihydroquinoline or tetrahydroquinoline compound.

20. A material according to claim 1, wherein the condensation component (B) is a 5-pyrazolone compound, a cresidine, phenetidine or N,N-(lower)dialkylaniline compound, a 3-(lower)alkyl-6-(lower)dialkylaminoindole compound, 2-(lower)alkylindole, 2-phenylindole, a 3-(lower)alkyl-6-(lower)alkoxyindole compound or a $C_1$–$C_8$alkyl-N-substituted 2-(lower)alkylindole, 2-phenylindole, 3-(lower)alkyl-6-(lower)alkoxyindole or 3-(lower)alkyl-6-(lower)dialkylaminoindole compound.

21. A material according to claim 1, wherein the condensation component (B) is a fluoran or phthalide compound which contains at least one amino group which is unsubstituted or monosubstituted by lower alkyl, cyclohexyl or benzyl.

22. A material according to claim 1, wherein the colour-developing component (C) is a Lewis acid, an acid clay, a solid carboxylic acid or a compound having a phenolic hydroxyl group.

23. A material according to claim 1, wherein the colour-developing component (C) is a zinc salt of a salicylic acid derivative, a metal-free phenolic compound, a phenolic resin, a zinc salt of a phenolic resin or an acid clay.

24. A material according to claim 1 which is pressure-sensitive.

25. A material according to claim 24, wherein components (A) and (B) are dissolved in an organic solvent.

26. A material according to claim 25, wherein components (A) and (B) are microencapsulated.

27. A recording material according to claim 24, wherein components (A) and (B) are incorporated in one back layer or independently into two back layers of a transfer sheet and component (C) is present in a front layer of a receptor sheet.

28. A material according to claim 24, wherein component (C) is a zinc salt of a salicylic acid derivative or an acid clay.

29. A material according to claim 1 which is heat-senstive.

30. A material according to claim 29 which comprises 1 to 4 layers on a substrate, wherein components (A), (B) and (C) are incorporated each together with a binder in at least one of the layers.

31. A material according to claim 1, wherein components (A) and (B) are present together with one or more conventional colour formers.

32. A material according to claim 31, wherein the conventional colour formers present are 3,3-bis(aminophenyl)phthalide, 3-indolyl-3-aminophenylaza- or -diazaphthalide, 3,3-bis(indolyl)phthalide, 3-aminofluorans, 6-dialkylamino-2-dibenzylaminofluorans, 6-dialkylamino-3-methyl-2-arylaminofluorans, 3,6-bisalkoxyfluorans, 3,6-bis(diarylamino)fluorans, leukoauramines, spiropyrans, spirodipyrans, chromenopyrazoles, chromenoindoles, benzoxazines, phenoxazines, phenothiazines, quinazolines, rhodamine lactams, carbazolylmethanes or triarylmethanes.

* * * * *